US008437485B2

(12) United States Patent
Kuhn-Rahloff et al.

(10) Patent No.: US 8,437,485 B2
(45) Date of Patent: May 7, 2013

(54) METHOD AND DEVICE FOR IMPROVED SOUND FIELD RENDERING ACCURACY WITHIN A PREFERRED LISTENING AREA

(75) Inventors: Clemens Kuhn-Rahloff, Zürich (CH); Etienne Corteel, Malakoff (FR); Renato Pellegrini, Niederhasli (CH); Matthais Rosenthal, Dielsdorf (CH)

(73) Assignee: Sonicemotion AG, Oberglatt (CH)

( * ) Notice: Subject to any disclaimer, the term of this patent is extended or adjusted under 35 U.S.C. 154(b) by 166 days.

(21) Appl. No.: 12/734,309

(22) PCT Filed: Oct. 27, 2008

(86) PCT No.: PCT/EP2008/064500

§ 371 (c)(1),
(2), (4) Date: Jul. 26, 2010

(87) PCT Pub. No.: WO2009/056508

PCT Pub. Date: May 7, 2009

(65) Prior Publication Data

US 2010/0296678 A1 Nov. 25, 2010

(30) Foreign Application Priority Data

Oct. 30, 2007 (EP) ..... 07021162

(51) Int. Cl.
*H04R 5/02* (2006.01)
*H04R 29/00* (2006.01)

(52) U.S. Cl.
USPC ..... 381/303; 381/300; 381/59; 381/58

(58) Field of Classification Search ..... 381/303, 381/300, 307, 1, 17, 56–59, 80, 81, 96
See application file for complete search history.

(56) References Cited

U.S. PATENT DOCUMENTS

| | | | | |
|---|---|---|---|---|
| 5,233,664 | A * | 8/1993 | Yanagawa et al. | 381/89 |
| 7,580,530 | B2 * | 8/2009 | Konagai et al. | 381/61 |
| 7,936,886 | B2 * | 5/2011 | Kim | 381/59 |
| 8,160,268 | B2 * | 4/2012 | Horbach | 381/89 |
| 2004/0223620 | A1 * | 11/2004 | Horbach et al. | 381/59 |
| 2004/0228498 | A1 * | 11/2004 | Sekine | 381/303 |
| 2005/0031129 | A1 * | 2/2005 | Devantier et al. | 381/58 |
| 2006/0269070 | A1 * | 11/2006 | Miura et al. | 381/17 |
| 2009/0010455 | A1 * | 1/2009 | Suzuki et al. | 381/97 |
| 2010/0177909 | A1 * | 7/2010 | Aarts et al. | 381/92 |
| 2011/0135124 | A1 * | 6/2011 | Steffens et al. | 381/300 |

* cited by examiner

*Primary Examiner* — Xu Mei
(74) *Attorney, Agent, or Firm* — Edwin D. Schindler

(57) ABSTRACT

A method and a device for sound field reproduction from a first audio input signal uses a plurality of loudspeakers for synthesizing a sound field within a preferred listening area in which none of the loudspeakers are located and therefore described as emanating from a virtual source. The method further includes the steps of calculating a plurality of positioning filter coefficients using virtual source description data and loudspeaker description data according to a sound field reproduction technique; and modifying the first audio input signal using the positioning filter coefficients to form second audio input signals. A loudspeaker ranking of the importance of each loudspeaker for the synthesis of the sound field within the preferred listening area is therefore defined. Then, second audio input signals are modified according to the loudspeaker ranking to form third audio input signals. Finally, the loudspeakers are alimented with the third audio input signals which synthesize a sound field.

12 Claims, 8 Drawing Sheets

Figure 1:
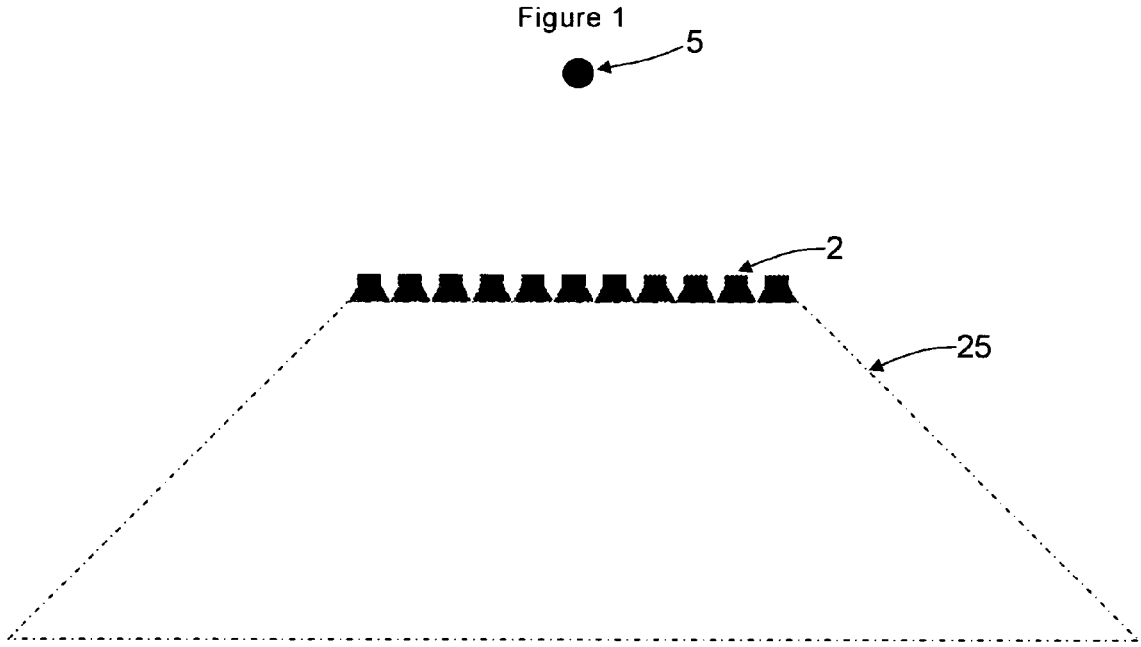

METHOD AND DEVICE FOR IMPROVED SOUND FIELD RENDERING ACCURACY WITHIN A PREFERRED LISTENING AREA

The Invention relates to a method and a device for sound field reproduction from a first audio input signal using a plurality of loudspeakers aiming at synthesizing a sound field within a preferred listening area in which none of the loudspeakers are located, said sound field being described as emanating from a virtual source, said method comprising steps of calculating positioning filters using virtual source description data and loudspeaker description data according to a sound field reproduction technique which is derived from a surface integral, and applying positioning filter coefficients to filter the first audio input signal to form second audio input signals.

Sound field reproduction refers to the synthesis of physical properties of an acoustic wave field within an extended portion of space. This framework enables to get rid of the well known limitations of stereophonic based sound reproduction techniques concerning listener positioning constraints, the so-called "sweet spot". The sweet spot is a small area in which the illusion, on which rely stereophonic principles, is valid. In the case of two channels stereophony, the voice of a singer can be located in the middle of the two loudspeakers if the listener is located on the loudspeakers midline. This illusion is referred to as phantom source imaging. It is simply created by feeding both loudspeakers with the same signal. However, if the listener moves, the illusion disappears and the voice will be heard on the closest loudspeaker. Therefore, no phantom source imaging is possible outside of the "sweet spot".

It is generally assumed that the listener is located at a distance from each loudspeaker which equals the loudspeaker spacing. This enables one to define so-called "panning laws" to position a virtual source at a given angular position from the listener. However, this can only be experienced if the listener is located exactly at the sweet spot.

Sound field reproduction techniques don't make any assumption about the listener position. Virtual sound imaging is realized by synthesizing a target sound field. There are three methods for describing the target sound field:

an object based description,
a wave based description,
a surface description.

In the object based description, the target wave field is described as an ensemble of sound sources. Each source is further defined by its position relative to a given reference point and its radiation characteristics. From this description, the sound field can be estimated at any point of space. In the wave based description, the target sound field is decomposed into so-called "spatially independent wave components" that provide a unique representation of the spatial characteristics of the target sound field. Depending on the chosen coordinate, the spatially independent wave components are usually:

cylindral harmonics (polar coordinates),
spherical harmonics (spherical coordinates),
plane waves (Cartesian coordinates).

For an exact description of the sound field, the wave based description requires an infinite number of spatially independent wave components. In practice, a limited number of components are used which provides a description of the sound field which remains valid in a reduced portion of space.

Finally, the surface description relies on the continuous description of the pressure and/or the normal component of the pressure gradient of the target sound field at the boundaries of a subspace Ω. From that description, the target sound field can be estimated in the complete subspace Ω using so-called surface integral (Rayleigh 1, Rayleigh 2, and Kirchhoff-Helmholtz Integrals).

It should be noted that there exist transformations to transpose the descriptions using one method to another method. For example, the object based description can be easily transformed in the surface description by extrapolating the sound field radiated by the acoustical objects at the boundaries of a subspace Ω.

In the past years, several methods have been developed to enable the synthesis of a target wave field in an extended listening area. One of such method relies on the recreation of the curvature of the wave front of an acoustic field emitted by a virtual source (object based description) by using a plurality of loudspeakers. This method has been disclosed by A. J. Berkhout in "A holographic approach to acoustic control", Journal of the Audio Eng. Soc., Vol. 36, pp 977-995, 1988, and is known under the name "Wave Field Synthesis".

A second method relies on the decomposition of a wave field into spatially independent wave field components such as spherical harmonics or cylindrical harmonics (wave based description). This second method has been disclosed by M. A. Gerzon in "Ambisonic in multichannel broadcasting and video", Journal of the Audio Engineering Society, vol. 33, pp. 859-871, 1985.

Both methods are mathematically linked as disclosed by Jérôme Daniel, Rozenn Nicol and Sébastien Moreau in "Further Investigations of High Order Ambisonics and Wavefield Synthesis for Holophonic Sound Imaging", Audio Engineering Society, Proceedings of the 114th AES Convention, Amsterdam, The Netherlands, Mar. 22-25, 2003. They are generally referred to as Holophonic methods.

In theory, these methods allow the control of a wave field within a certain listening zone in all three spatial dimensions. However, this is only correct if an infinite number of loudspeakers are used (a continuous distribution of loudspeakers). In practice, a finite number of loudspeakers is used which creates physical inaccuracies in the synthesized sound field.

As an example, Wave Field Synthesis is derived from the Rayleigh 1 integral which requires a continuous planar infinite distribution of ideally omnidirectional secondary sources (loudspeakers). Three successive approximations are used to derive Wave Field Synthesis from the Rayleigh 1 integral assuming that virtual sources and listeners are in the same horizontal plane:

1. reduction of the infinite plane to an infinite line lying in the horizontal plane where sources and listeners are,
2. reduction of the infinite line to a segment to fit in the listening room,
3. spatial sampling of the segment to a finite number of positions where the loudspeakers are.

Following these approximations, the loudspeaker array can be regarded as an acoustical aperture through which the incoming sound field (as emanating from a target sound source) propagates into an extended yet limited listening area. Simple geometrical considerations enable one to define a source/loudspeaker visibility area in which the virtual source is "visible" through the loudspeaker array. The term "visible" means here, that the straight line joining the virtual source and the listener crosses the line segment on which loudspeakers are located. This source/loudspeaker visibility area 25 is displayed in FIG. 1 in which a virtual source 5 is visible through the loudspeaker 2 array only in a limited portion of space. It outlines the limited area in which the target sound field can be properly synthesized as disclosed by E. W. Start in "Direct Sound Enhancement by Wave Field Synthesis," Ph.D. Thesis, Technical University Delft, Delft, The Netherlands (1997).

Figure 2:
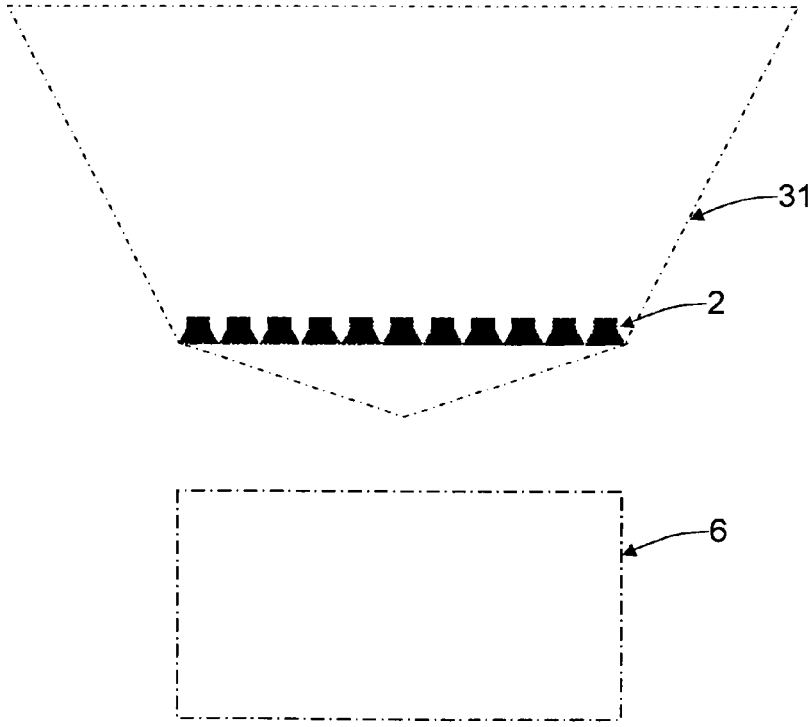

Sources can conversely be located only in a limited zone so that they remain visible from within the entire listening area as disclosed by E. Corteel in "Equalization in extended area using multichannel inversion and wave field synthesis," Journal of the Audio Engineering Society, vol. 54, no. 12, 2006. FIG. 2 describes the resulting source positioning area 31 considering the listening area 6 and the loudspeaker 2 array extension.

The source positioning area can be extended by adding supplementary loudspeaker arrays around the listening area. Considering the obtained loudspeaker array geometry, Rayleigh 1 integral does not apply anymore. Loudspeaker driving signals are thus derived from Kirchhoff-Helmholtz integral using similar approximations:

approximation 1: reduction of the secondary source surface to a linear distribution in the horizontal plane, approximation 2: selection of relevant loudspeakers, approximation 3: sampling of the continuous distribution to a finite number of aligned loudspeakers, as disclosed by R. Nicol in <<Restitution sonore spatialisée sur une zone étendue: application à la téléprésence>>, Ph.D. thesis, Université du Maine, Le Mans, France, 1999.

In the original formulation of Kirchhoff-Helmholtz integral, the secondary source distribution is composed of ideal omnidirectional sources (monopoles) and ideal bi-directional sources (dipoles). However, as disclosed by R. Nicol in <<Restitution sonore spatialisée sur une zone étendue: application à la téléprésence>>, Ph.D. thesis, Université du Maine, Le Mans, France, 1999, the loudspeakers of the array can be splitted into two categories (relevant and irrelevant loudspeakers) for which:

1. the contributions of monopoles and dipoles are in phase (relevant loudspeakers),
2. the contributions of monopoles and dipoles are out of phase (irrelevant loudspeakers) and tend to compensate for each other.

The discrimination of relevant toward irrelevant loudspeakers can be made using simple geometrical criteria according to the position of the virtual source and the secondary source position if virtual sources are located outside of the listening area. In the case of virtual sources located within the listening area (also referred to as focused sources), the selection criteria should also consider a reference position as disclosed in DE 10328335.

The sound fields emitted by the monopoles and the dipoles have mostly similar spatio-temporal characteristics. However, relevant monopoles and relevant dipoles are in phase and tend to produce only double sound pressure level whereas irrelevant monopoles and irrelevant dipoles are out of phase and only tend to compensate for each other. Therefore, only relevant monopoles could be used for the synthesis of the target sound field. This is useful since most available loudspeakers have more omnidirectional radiation characteristics. A more general class of sound field rendering techniques based on holophonic principles can be defined using simplifications of the "surface integrals" as disclosed by R. Nicol in <<Restitution sonore spatialisée sur une zone étendue: application àla téléprésence>>, Ph.D. thesis, Université du Maine, Le Mans, France, 1999. The proposed simplifications involve:

1. the reduction of the spatial extension of the required loudspeaker distribution (approximation 1 and 2 for Wave Field Synthesis),
2. the spatial sampling of the required loudspeaker distribution (approximation 3 for Wave Field Synthesis).

The previously defined approximations to these "surface integrals" (Rayleigh 1 and Kirchhoff-Helmholtz) introduce inaccuracies in the synthesized sound field compared to the target sound field as disclosed by E. Corteel in "Caractérisation et extensions de la Wave Field Synthesis en conditions réelles", Université Paris 6, PhD thesis, Paris, 2004. In the case of Wave Field Synthesis, the reduction of the secondary source surface to a linear distribution in the horizontal plane (approximation 1) limits the technique to the reproduction of virtual sources in the horizontal plane (2D reproduction) and modifies the level of the sound field compared to the target. Approximation 2 introduces diffraction artefacts which can be reduced by tapering loudspeakers located at the extremities of the array. Approximation 1 and 2 mostly reduce the capabilities of the rendering system (size of the listening area, positioning of the virtual sources). They hardly modify the quality of the sound field perceived by a listener in terms of coloration or localization accuracy at a given position within the listening area as disclosed by E. Corteel in "Caractérisation et extensions de la Wave Field Synthesis en conditions réelles", Université Paris 6, PhD thesis, Paris, 2004. Approximation 3 limits the exact reproduction of the target wave field only below a certain frequency, the Nyquist frequency of the spatial sampling process, that is commonly referred to as "spatial aliasing frequency". This spatial sampling introduces inaccuracies that are perceived as artefacts in terms of localization of the virtual source and coloration as disclosed by E. Corteel, K. V. NGuyen, O. Warusfel, T. Caulkins, and R. S. Pellegrini in "Objective and subjective comparison of electrodynamic and MAP loudspeakers for Wave Field Synthesis", 30th international conference of the Audio Engineering Society, 2007.

This spatial sampling process is a mandatory task for any sound field reproduction techniques that are based on surfaces integrals since no currently available transduction technology is capable of continuously controlling the radiation of an acoustical source (continuous loudspeaker distribution). This surface has to be spatially sampled and this creates spatial aliasing artefacts that reduce the quality of the synthesized sound field. The spatial sampling process is a key cost factor for sound field reproduction systems since it determines the number of loudspeakers and channels to control independently using digital signal processing techniques.

A solution to increase the spatial aliasing frequency for Wave Field Synthesis has been proposed by Evert Start in "Direct Sound Enhancement by Wave Field Synthesis", PhD thesis, Delft University of Technology, the Netherlands, 1997. It consists in synthesizing virtual sources having a directivity index which is an increasing function of frequency which depends on loudspeaker spacing. The proposed method also requires that the loudspeakers have the same radiation characteristics. This method is however putting constraints on the manipulation of the radiation characteristics of the virtual sources and on the required radiation characteristics of the loudspeakers. The latter is the most problematic aspect since most existing loudspeakers do not have the required radiation pattern.

Another solution to increase the spatial aliasing frequency has been proposed by Etienne Corteel in "On the use of irregularly spaced loudspeaker arrays for Wave Field Synthesis, potential impact on spatial aliasing frequency", DAFX06, 2006, available at http://www.dafx.ca/proceedings/papers/p_209.pdf. It consists in using irregularly spaced loudspeaker arrays to increase the spatial aliasing frequency for Wave Field Synthesis. It shows that double logarithmically spaced array, the spatial aliasing frequency can be increased by 20% compared to a regularly spaced loudspeaker array having the same number of loudspeakers and same length. However, the increase of aliasing frequency is only effective for sources located outside of the listening area. For sources located within the listening area (alternatively called "focused sources"), this loudspeaker arrangement reduces the spatial aliasing frequency compared to the equivalent regularly spaced array.

Additional rendering inaccuracies are to be expected from the room acoustics of the listening environment as disclosed by E. Corteel and R. Nicol in "Listening room compensation for wave field synthesis. What can be done?", Proceedings of the 23rd Convention of the Audio Engineering Society, Helsingor, Danemark, June 2003. The rendering sound system always interacts with the listening room, so that the listener does not perceive the target virtual sound field, but a mixture between this latter and the listening room effect. Local reflections and reverberation are added by the listening room to the sound field produced by the loudspeakers, so that the sound field perceived by the listener may differ more or less from the expected result. The most obvious effect relies on the early reflections within the first 10-30 ms that can produce sound coloration, distance perception distortion, and angular localization errors. For small listening room, room modes are also audible at low frequencies, reducing the clarity and producing sound coloration as disclosed by R. S. Pellegrini, "A Virtual Listening Room as an Application of Auditory Virtual Environments", Ph. D. Thesis, Ruhr-Universität, Bochum, Germany, 2001.

To discard the listening room interaction, one way consists in considering either an anechoic listening environment or playback over headphone. But these solutions are not really convenient for most applications. A more general way to deal with this problem is proposed by the room compensation strategy, that aims at cancelling—or more realistically reducing—the influence of the listening room on the virtual sound field perceived by the listener. Room compensation aims at cancelling out the acoustics of the listening environment using multichannel inverse filtering techniques as disclosed by E. Corteel in "Caractérisation et extensions de la Wave Field Synthesis en conditions réelles", Université Paris 6, PhD thesis, Paris, 2004. These techniques allow for the reduction of the level of some early reflections within a large listening area. However, they put heavy constraints on the required processing power and they suffer from important practical and theoretical limitations that reduce their efficiency in realistic situations as disclosed by E. Corteel in "Caractérisation et extensions de la Wave Field Synthesis en conditions réelles", Université Paris 6, PhD thesis, Paris, 2004.

Figure 3:
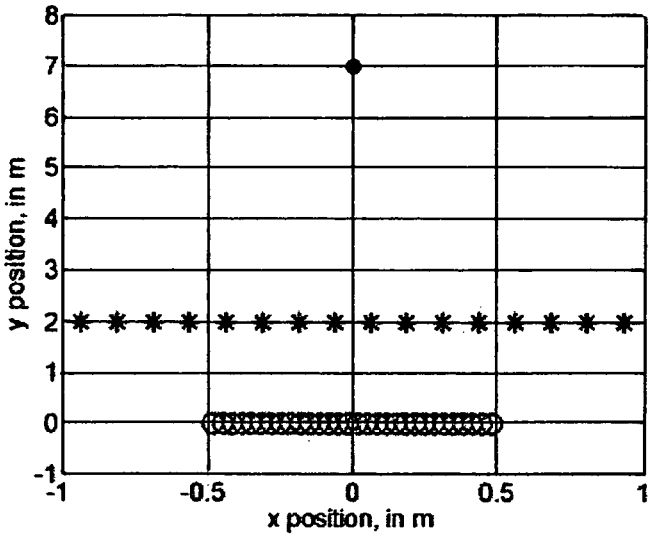
Figure 4:
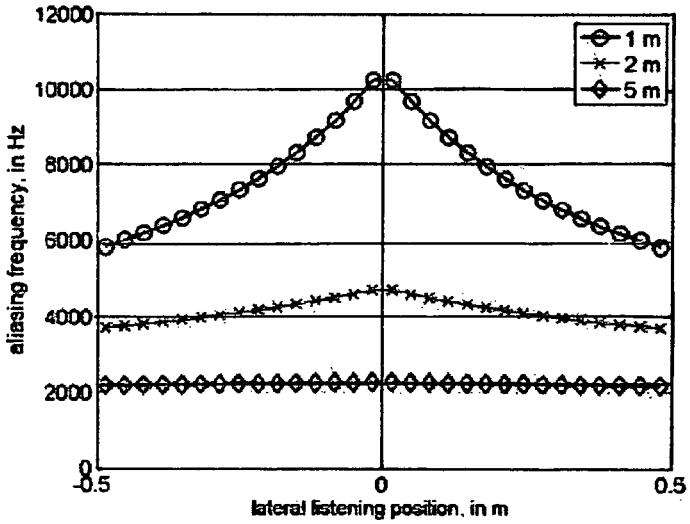

A formula for the calculation of the spatial aliasing frequency has been proposed by Etienne Corteel in "On the use of irregularly spaced loudspeaker arrays for Wave Field Synthesis, potential impact on spatial aliasing frequency", DAFX06, 2006, available at http://www.dafx.ca/proceedings/papers/p_209.pdf. In contrary to previously known formulae, the proposed formula enables to account for finite length loudspeaker arrays and the dependency on listening position. It is based on the arrival time of loudspeakers' contribution at a given listening position for the synthesis of a virtual source using Wave Field Synthesis. In FIG. 4, the spatial aliasing frequency calculated with the proposed formula is displayed for various loudspeaker arrays having the same inter loudspeaker spacing (12.5 cm) but different lengths (1 m, 2 m, 5 m). FIG. 3 represents a top view of the considered configuration where black stars represent loudspeakers, open dots represent listening positions, and the filled dot represent the virtual source. This simulation shows that a large increase of the spatial aliasing frequency is obtained with a short array compared to long loudspeaker arrays. In this configuration we consider a restricted listening area of 1 m width. Therefore, reducing the length of the loudspeaker array can be considered as a solution to increase aliasing frequency. However, this solution suffers from various artefacts associated to the limited length of the loudspeaker array. First, the source visibility area (as described in FIG. 2) is very limited which heavily restricts the practical use of the sound reproduction system. Typically only sources between −10 and 10 degrees from the center listening position of FIG. 3 can be reproduced using the 1 m long loudspeaker array whereas sources from −50 to 50 degrees could be reproduced while fulfilling visibility constraints with the 5 m long loudspeaker array. Second, the limited length of the loudspeaker array may introduce more pronounced diffraction artefacts compared to long loudspeaker arrays. These artefacts may be accurately compensated for by tapering loudspeakers located at the extremities of the array but only at high frequencies as disclosed by E. Corteel in "Caractérisation et extensions de la Wave Field Synthesis en conditions réelles", Université Paris 6, PhD thesis, Paris, 2004.

Figure 5:
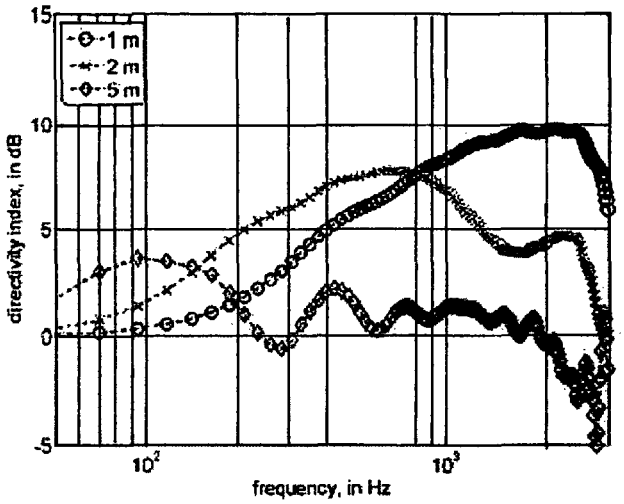

FIG. 5 shows the directivity index of loudspeaker arrays of various lengths for the synthesis of the virtual source displayed in FIG. 3 using Wave Field Synthesis. The directivity index is defined as the frequency dependent ratio between the acoustical energy conveyed in the frontal direction, i.e. within the listening area, to the averaged acoustical energy conveyed in all directions. The directivity index illustrates then the concentration of the acoustical energy in a certain direction, here, the listening area. The higher the directivity index, the lower is the acoustical energy spread in the listening room. Therefore, a higher directivity index corresponds to reduced rendering artefacts due to the listening room acoustics without using complex active listening room compensation procedures. It can be seen that by reducing the length of the loudspeaker array, its directivity index increases, especially at frequencies above 800 Hz for which the 1 m long loudspeaker array has the highest directivity index. However, at lower frequencies a higher directivity index is obtained with shorter loudspeaker arrays. The 2 m long array has the highest directivity index between 150 Hz and 800 Hz and the 5 m loudspeaker array below 150 Hz.

Sound field reproduction techniques make no a priori assumption of the position of the listener enabling the reproduction of the sound field within an extended area. For Wave Field Synthesis, this area may typically span the entire listening room. However, there may be positions in the room where the listeners will never be because there are furniture or simply because their task or the situation does not require that. Therefore a preferred listening area could be defined in which listeners may preferably stand and where sound reproduction artefacts should be limited.

The aim of the invention is to increase the spatial aliasing frequency within a preferred restricted listening area where the listener may stand for a given number and spatial arrangement of loudspeakers. It is another aim of the invention to limit the required number of loudspeakers considering a given aliasing frequency and a given extension of the listening area to produce a cost effective solution for sound field reproduction. It is also an aim of the present invention to limit the interaction of the reproduction system with the listening room so as to automatically reduce the influence of the listening room acoustics on the perceived sound field by the listeners.

The invention consists in a method and a device in which a ranking of the importance of each loudspeaker for synthesizing a target sound field associated to a virtual source within a restricted preferred listening area is defined. Based on this ranking, the loudspeakers' alimentation signals derived from a first input signal are modified so as to increase the spatial aliasing frequency by creating a "virtually shorter loudspeaker array" using only loudspeakers that contribute significantly to the synthesis of the target sound field within a restricted preferred listening area.

Figure 6:
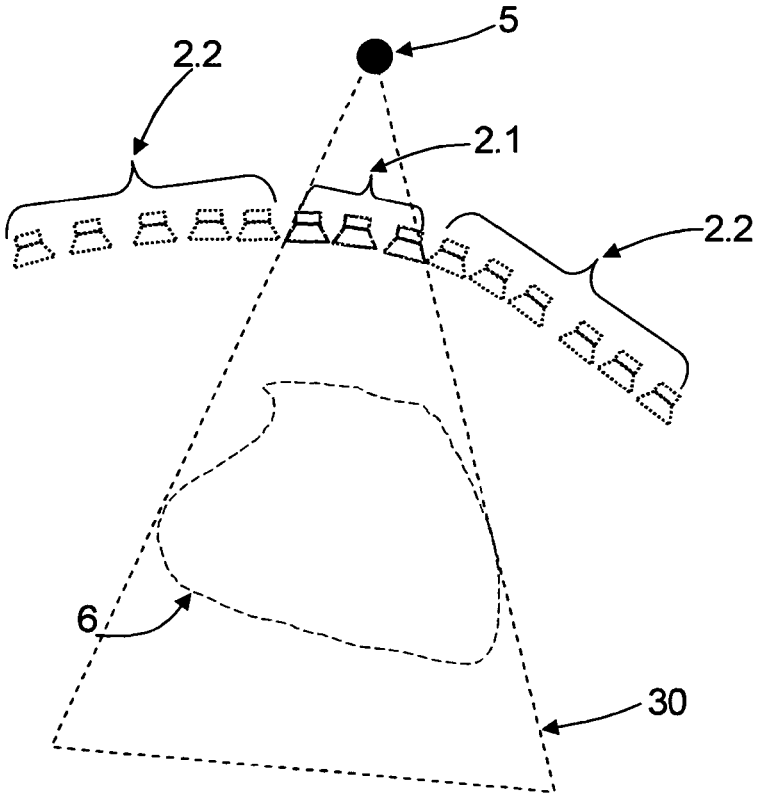

Instead of using a physically shorter array that would put restrictions on the positioning of the virtual source, the invention proposes to reduce the level of the alimentation signals of loudspeakers located outside of a source/listener visibility area. FIG. 6 describes the associated loudspeaker selection process for creating a virtually shorter loudspeaker array according to the virtual source 5 position and the preferred listening area extension. In this FIG., the associated source/listener visibility area 30 is defined according to the virtual source 5 position such that it encompasses the entire preferred listening area 6. Loudspeakers located within source/listener visibility area 2.1 can thus be selected to form a virtually shorter array. In addition, the length of the virtual loudspeaker array may be frequency dependent so as to maximise the directivity index by creating a virtually longer loudspeaker array at low frequencies than at high frequencies (see FIG. 5). The invention proposes a more general formulation that defines a loudspeaker ranking corresponding to the importance of the considered loudspeaker for the synthesis of the target sound field within the restricted listening area.

In other words, there is presented a method and a device for sound field reproduction from a first audio input signal using a plurality of loudspeakers aiming at synthesizing a sound field within a preferred listening area in which none of the loudspeakers are located, said sound field being described as emanating from a virtual source. The method comprises steps of calculating positioning filter coefficients using virtual source description data and loudspeaker description data according to a sound field reproduction technique which is derived from a surface integral. The first audio input signal are modified using the positioning filter coefficients to form second audio input signals. Therefore, loudspeaker ranking data representing the importance of each loudspeaker for the synthesis of the sound field within the preferred listening area are calculated. Then, second audio input signals are modified according to the loudspeaker ranking data to form third audio input signals. Finally, loudspeakers are alimented with the third audio input signals and synthesize a sound field.

Furthermore the method may comprise steps wherein the loudspeaker ranking data are defined using the virtual source description data, loudspeaker description data and the listening area description data. And the method may also comprise steps wherein the loudspeaker ranking is typically lower for loudspeakers located outside of the source/listener visibility area than for loudspeakers located within a source/listener visibility area.

wherein the source/listener visibility area is defined as the minimum solid angle at the virtual source that encompass the entire preferred listening area.

wherein the loudspeaker ranking of loudspeakers located outside of the source/listener visibility area is a decreasing function of the distance of the loudspeaker to the boundaries of the source/listener visibility area.

wherein the loudspeaker ranking data are defined by a decreasing function of the distance of the position of a loudspeaker to the line joining the position of the virtual source and a reference listening position in the preferred listening area.

wherein the modification of the second audio input signals to form loudspeakers' input signals implies at least to reduce the level of the second audio input signals of loudspeakers having a low ranking.

wherein the level reduction of the second audio input signals of loudspeakers having a low ranking is frequency dependent.

wherein modifying the second audio input signals according to the loudspeaker ranking data to form third audio input signals is performed in order to increase, in the preferred listening area, the Nyquist frequency associated to the spatial sampling of the required loudspeaker distribution in the definition of the sound field rendering technique that is used to calculate the positioning filter coefficients.

Moreover the invention comprises a device for sound field reproduction from a first audio input signal using a plurality of loudspeakers aiming at synthesizing a sound field described as emanating from a virtual source within a preferred listening area in which none of the loudspeakers are located. Said device comprises a positioning filters computation device for calculating a plurality of positioning filters using virtual source description data and loudspeaker description data, a sound field filtering device to compute second audio input signals from the first audio input signal using the positioning filters. Said device is characterized by a loudspeaker ranking computation device to compute loudspeaker ranking data representing the importance of each loudspeaker for the synthesis of the sound field within the preferred listening area, a listening area adaptation computation device to modify the second audio input signals according to the loudspeaker ranking and form third audio input signals that aliment the loudspeakers.

Furthermore said device may preferably comprise elements:

wherein the listening area adaptation computation device comprises a modification filters coefficients computation device to compute modification filters coefficients.

wherein the listening area adaptation computation device also comprises a second audio input signals modification device that modifies the second audio input signals using the modification filters coefficients.

The invention will be described with more detail hereinafter with the aid of an example and with reference to the attached drawings, in which FIG. 1 describes the source/loudspeaker visibility area.

FIG. 2 describes the source positioning area.

FIG. 3 represents a top view of the considered loudspeakers, listening positions, and virtual source configuration.

FIG. 4 displays the spatial aliasing frequency at the listening positions shown in FIG. 3 for various loudspeaker arrays having the same inter loudspeaker spacing (12.5 cm) but different lengths (1 m, 2 m, 5 m).

FIG. 5 shows the directivity index of loudspeaker arrays of various lengths for the synthesis of the virtual source displayed in FIG. 3 using Wave Field Synthesis.

FIG. 6 describes the selection process for creating a virtually shorter loudspeaker array according to the virtual source position and the preferred listening area extension.

Figure 7:
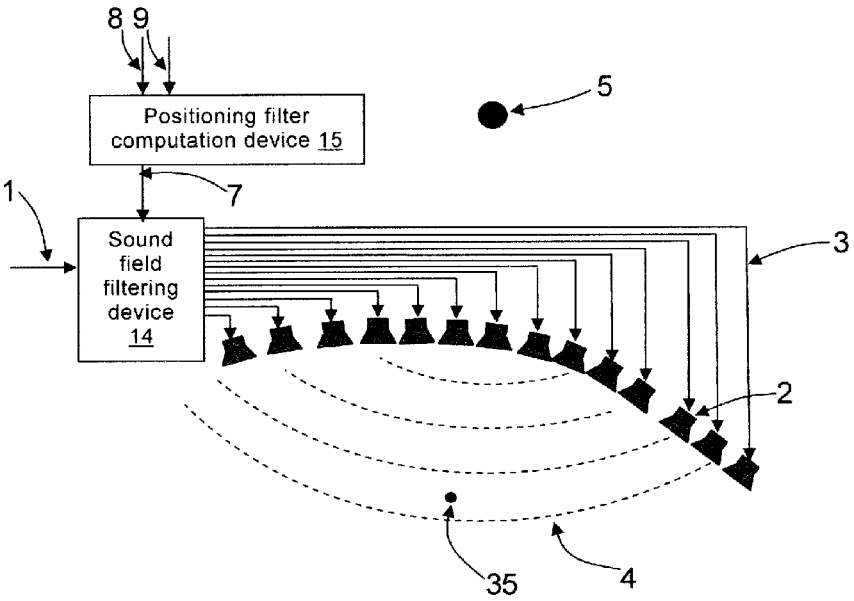

FIG. 7 describes a sound field rendering device according to state of the art.

Figure 8:
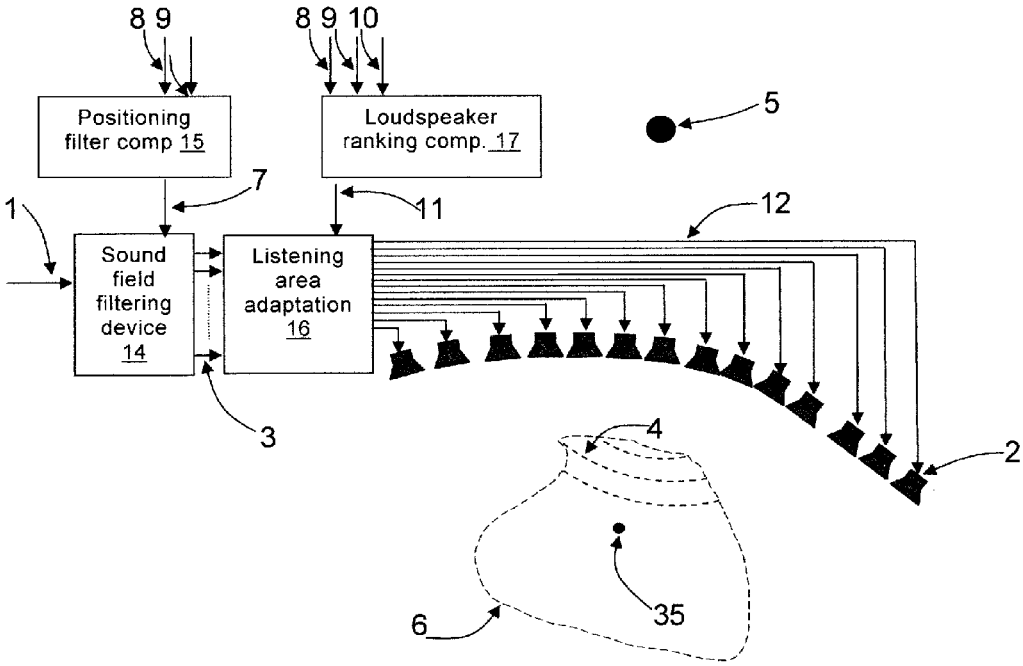

FIG. 8 describes a sound field rendering device according to the invention.

Figure 9:
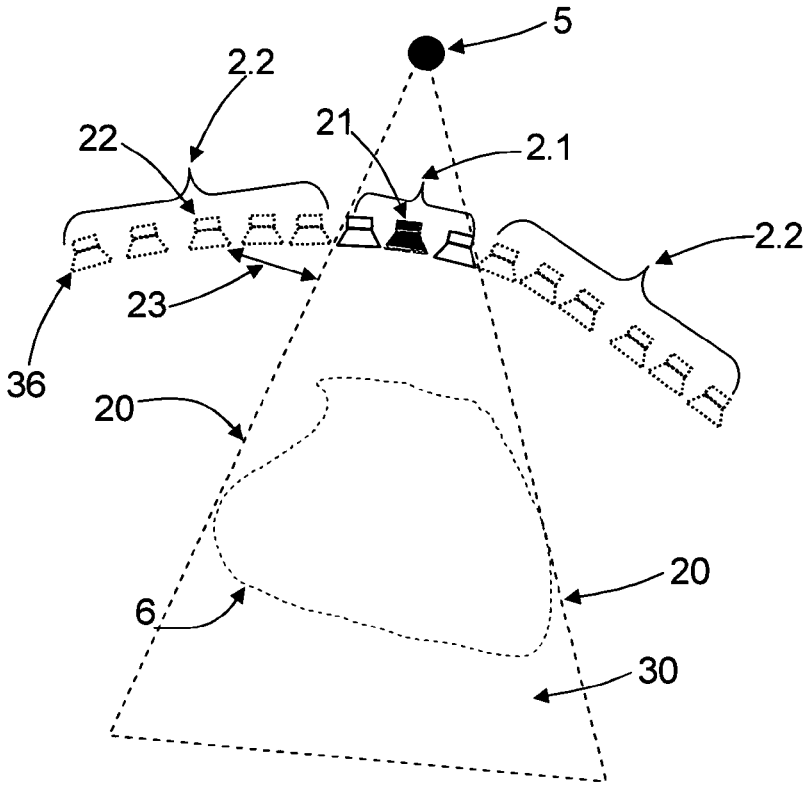

FIG. 9 describes a first method to extract loudspeaker ranking data.

Figure 10:
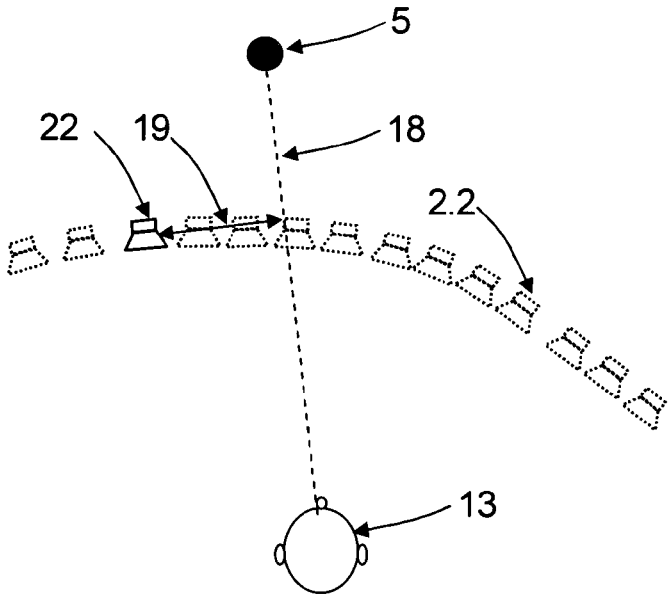

FIG. 10 describes a second method to extract loudspeaker ranking data.

Figure 11:
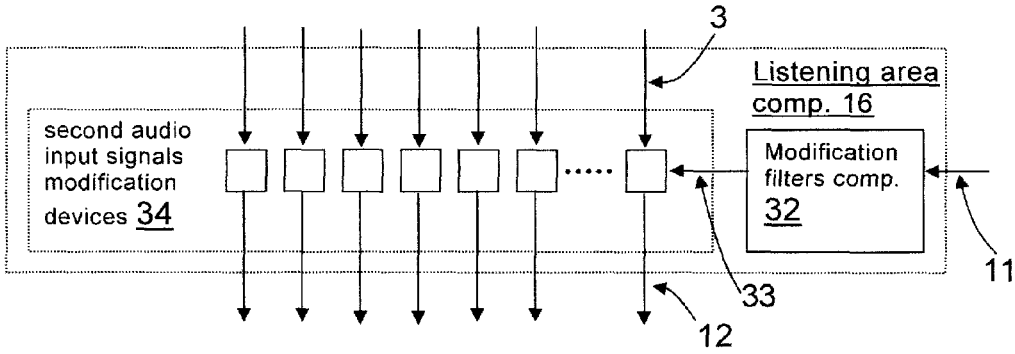

FIG. 11 describes the listening area adaptation computation device.

FIG. 12-15 describe further embodiments of the invention.

FIG. 1-5 were discussed in the introductory part of the specification and are all representing the state of the art. Therefore these figures are not further discussed at this stage.

FIG. 6 was already described and is also not further discussed at this stage.

FIG. 7 describes a sound field rendering device according to state of the art. In this device, a sound field filtering device 14 calculates a plurality of second audio signals 3 from a first audio input signal 1, using positioning filters coefficients 7. Said positioning filters coefficients 7 are calculated in a positioning filters computation device 15 from virtual source description data 8 and loudspeakers description data 9. The position of loudspeakers 2 and the virtual source 5, comprised in the virtual source description data 8 and the loudspeaker description data 9, are defined relative to a reference position 35. The second audio signals 3 drive a plurality of loudspeakers 2 synthesizing a sound field 4.

FIG. 8 describes a sound field rendering device according to the invention. In this device, a sound field filtering device 14 calculates a plurality of second audio signals 3 from a first audio input signal 1, using positioning filters coefficients 7 that are calculated in a positioning filters computation device 15 from virtual source description data 8 and loudspeakers positioning data 9. The position of loudspeakers 2 and the virtual source 5, comprised in the virtual source description data 8 and the loudspeaker description data 9, are defined relative to a reference position 35. A listening area adaptation computation device 16 calculates third audio input signals 12 from second audio input signals 3 using loudspeaker ranking data 11 derived from virtual source description data 8, loudspeakers positioning data 9, and listening area description data 10 in a loudspeaker ranking computation device 17. The third audio signals 12 drive a plurality of loudspeakers 2 synthesizing a sound field 4 in a restricted listening area 6.

FIG. 9 describes a first method to extract loudspeaker ranking data 11. In this method, a source listener visibility area 30 is defined as being comprised within the minimum solid angle at the virtual source 5 that encompasses the entire preferred listening area 6. A plurality of loudspeakers 2.1 located within the source/listener visibility area 30 receives a high ranking, typically 100%. A plurality of loudspeakers 2.2 located outside of the source/listener visibility area 30 receives a lower ranking. Loudspeaker ranking data 11 may typically be a decreasing function of the distance 23 of the loudspeaker 22 to the boundaries 20 of the source/listener visibility area 30. Loudspeaker 22 may typically receive a ranking of 35% whereas loudspeaker 36, being at a higher distance from the boundaries 20 of the source/listener visibility area 30 may receive a ranking of 10%.

FIG. 10 describes a second method to extract loudspeaker ranking data 11 for which the preferred listening area 6 according to FIG. 9 is reduced to a single listener reference position 13. In this method the loudspeaker ranking data 11 are calculated as a decreasing function of the distance 19 of a loudspeaker 22 to a source/loudspeaker line 18 joining the virtual source 5 and a reference listening position 13.

FIG. 11 describes the listening area adaptation computation device 16. In this device 16, the second audio input signals are modified in a second audio input signals modification device 34 using modification filters coefficients 33. Modification filters coefficients 33 are calculated in a modification filters coefficients computation device 32 from loudspeaker ranking data 11.

Figure 12:
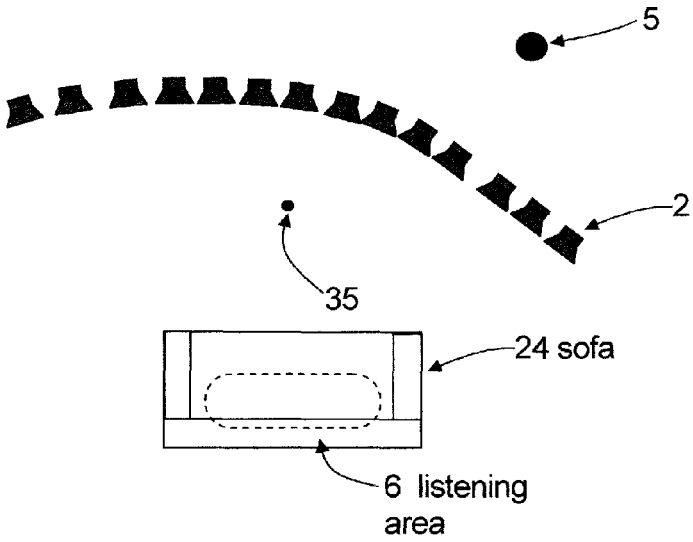

In a first embodiment of the invention, the listening area is restricted to a limited area in which listeners are located (ex: a sofa). In this embodiment, a limited number of loudspeakers can be positioned for example in the frontal area in coherence with a projected image. According to the invention, the number of loudspeakers can be restricted compared to the "full room" listening area with the same quality (i.e. aliasing frequency). For example, in a Wave Field Synthesis reproduction system, this reduces the required hardware effort and cost. This embodiment is shown in FIG. 12 where an ensemble of loudspeakers 2 are installed in a room where stands a sofa 24 on which listeners are to be seated. A preferred listening area 6 can thus be defined around the possible positions of the head of the listeners. On one hand, this offers a clear advantage compared to stereophonic reproduction systems, since the position of ideal listening area can be freely chosen by the user. The "sweet spot" is not limited anymore to a position strictly defined by the loudspeaker position. On the other hand, this example shows an advantage e.g. compared to conventional wave field synthesis systems. In the preferred listening area, the sound field can be reproduced correctly. However, the number of loudspeakers is substantially reduced compared to conventional Wave Field Synthesis systems. In this embodiment, the virtual source description data 8 (cf. FIGS. 7, 8, 12) may comprise the position of the virtual source 5 relative to a reference position 35. The considered coordinate system may be Cartesian, spherical or cylindrical. The virtual source description data 8 may also comprise data describing the radiation characteristics of the virtual source 5, for example using frequency dependant coefficients of a set of spherical harmonics as disclosed by E. G. Williams in "Fourier Acoustics, Sound Radiation and Nearfield Acoustical Holography", Elsevier, Science, 1999. The loudspeaker description data 9 (cf. FIGS. 7, 8, 12) may comprise the position of the loudspeakers relative to a reference position 35, preferably the same as for the virtual source description data 8. The considered coordinate system may be Cartesian, spherical or cylindrical. As for the virtual source 5, the loudspeaker description data 9 may also comprise data describing the radiation characteristics of the loudspeakers, for example using frequency dependant coefficients of a set of spherical harmonics. The listening area description data 10 describe the position and the extension of the listening area 6 relative to a reference position 35, preferably the same as for the virtual source description data 8. The considered coordinate system may be Cartesian, spherical or cylindrical. The positioning filter coefficients 7 may be defined using virtual source description data 8 and loudspeaker description data 9 according to Wave Field Synthesis as disclosed by E. Corteel in "Caractérisation et extensions de la Wave Field Synthesis en conditions réelles", Université Paris 6, PhD thesis, Paris, 2004, available at http://mediatheque.ircam.fr/articles/textes/Cortee104a/. The resulting filters may be finite impulse response filters. The filtering of the first input signal may be realized using convolution of the first input signal 1 with the positioning filter coefficients 7. The modification filter coefficients 33 (cf. FIG. 11) may be calculated so as to reduce the level of the second audio input signals 3, possibly with frequency dependant attenuation factors, for loudspeakers receiving low ranking 11. The attenuation factors may be linearly dependant to the loudspeaker ranking data 11, follow an exponential shape, or simply null below a certain threshold of the loudspeaker ranking data 11. The resulting filters may be infinite or finite impulse response filters. The modification of the second audio input signals 3 may be realized by convolving the second audio input signals 3 with the modification filters coefficients 33 (if finite impulse response filters are used).

Figure 13:
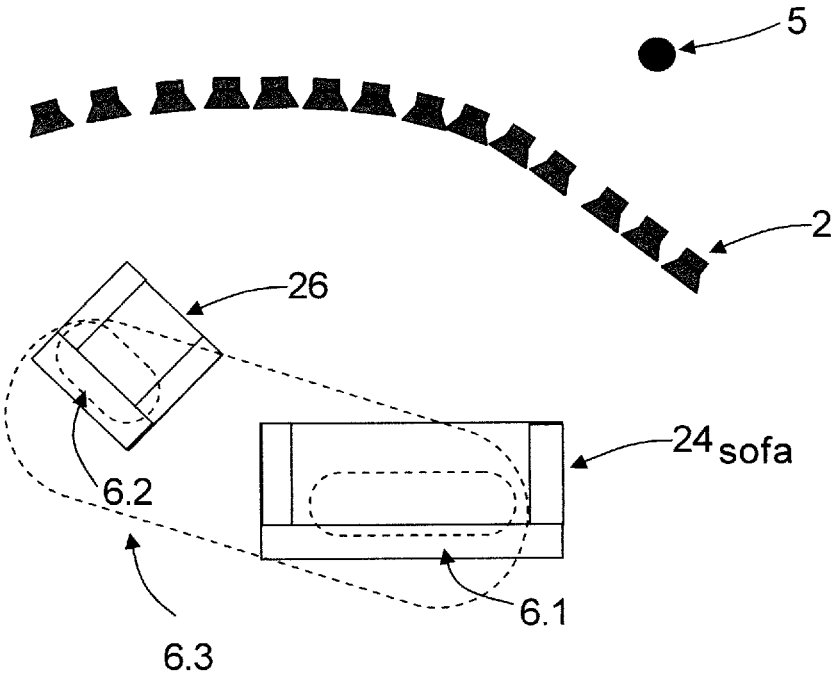

In a second embodiment of the invention listeners may be located at a limited number of pre-defined listening positions (ex: sofa, chair in front of a desk, . . . ). According to the invention, the listeners may create presets so as to optimize the sound rendering quality for these pre-defined locations. The presets can then be recalled directly by the listeners or by detecting the presence of the listener in one of the pre-defined zones. FIG. 13 shows a situation similar to FIG. 12 where a second preferred listening area 6.2 is defined at the position of a potential listener seated on a couch 26 in addition to the first preferred listening area 6.1 corresponding to the sofa 24. A third preferred listening area 6.3 encompasses the first and the second preferred listening area 6.1 and 6.2 assuming a degraded rendering quality (i.e. lower aliasing frequency).

Figure 14:
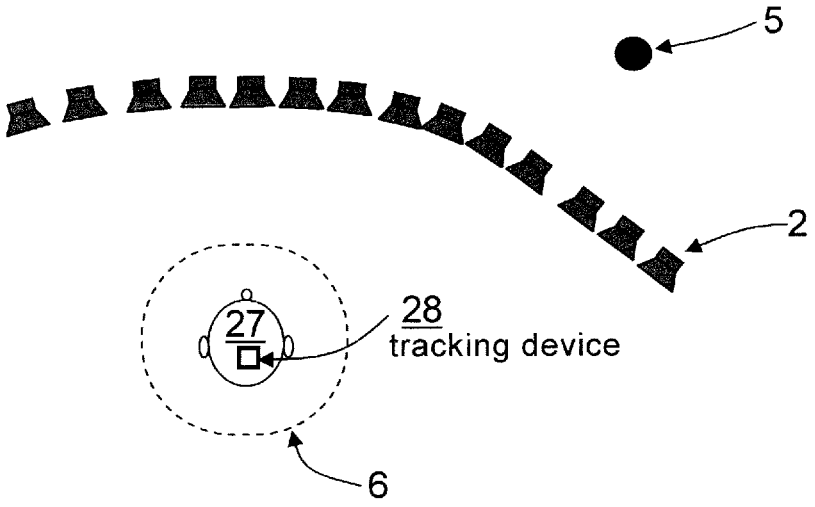
Figure 15:
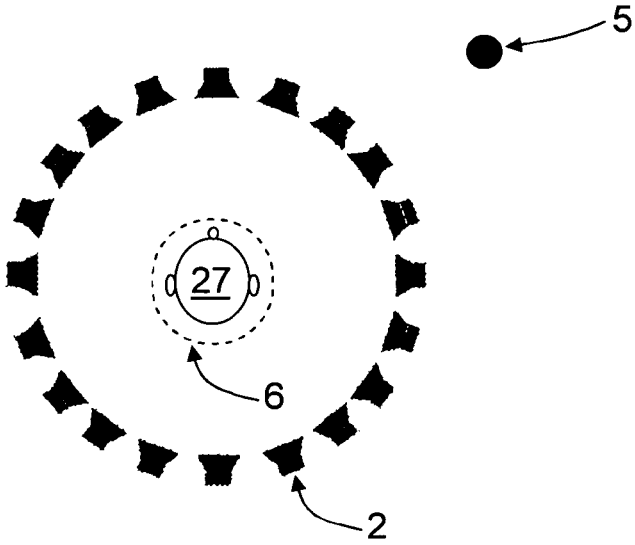

In a third embodiment of the invention, the position of the listeners may be tracked so as to continuously optimize the sound rendering quality within the effective covered listening area. FIG. 14 presents such an embodiment where a tracking device 28 provides the actual position of the listener 27 which defines an actual preferred listening area 6.

A fourth embodiment of the invention is a sound field simulation environment. In this embodiment, the listening area is restricted to a very limited zone around the head of the listener where a physically correct sound field reconstruction is targeted over all or most of the audible frequency range (typically 20-20000 Hz or 100-10000 Hz). The usual approach for a physically correct sound reproduction is to use binaural sound reproduction over headphones as described by Jens Blauert in "Spatial hearing: The psychophysics of human sound localization", revised edition, The MIT press, Cambridge, Mass., 1997. In practice, the said simulation approach with headphones using head-related transfer functions shows several drawbacks. The localization is disturbed by front-back confusions, out-of-head localization is limited and distance perception does not necessarily match the intended real image. The feeling of wearing a headphone reduces the feeling of being present into the virtual environment. In the past years, this method with headphones has been widely used since in theory it promises to reproduce physically correct ear input signals in order to create a spatial impression of sound. Practice has shown that the spatial impression provided by this method does not necessarily match the intended spatial sonic image and that strong differences in perception may occur from one listener to another due to mismatches of the used HRTFs in the signal processing to individual HRTFs of the listener. Such results have been published e.g. by H. Møller, M. F. Sørensen, C. B. Jensen, D. Hammershøi in "Binaural technique: Do we need individual recordings?", J. Audio Eng. Soc., Vol. 44, No. 6, pp. 451-469, June 1996 as well as by H. Møller, D. Hammershøi, C. B. Jensen, M. F. Sørensen in "Evaluation of artificial heads in listening tests", J. Audio Eng. Soc., Vol. 47, No. 3, pp. 83-100, March 1999.

Listener's head movements should also be recorded in order to update binaural sound reproduction such that the listener does not have the impression that the entire sound scene seems to follow her/him. However, the cost of commercially available head-tracking device is usually high and the update of headphone signals may also introduce artefacts. In contrast to this, by creating a physically correct sound field around the head of the listener, there is no need either for individual head related transfer function measurements or for complex compensation of head movements.

Using conventional sound field rendering techniques such as Wave Field Synthesis according to the state of the art, a loudspeaker spacing of about 2 cm would be required to reproduce a physically correct sound field within the required frequency range. This leads to an unpractical loudspeaker setup with very small loudspeakers which may be inefficient at low frequencies (typically below 200/300 Hz). According to the invention, a loudspeaker spacing of 12.5 cm may be sufficient (see center positions in FIG. 2) thus reducing the number of required loudspeakers and allowing for the use of conventional cost-effective loudspeaker techniques to deliver acceptable sound pressure level down to at least 100 Hz. An exemplary realization of this fourth embodiment is shown in FIG. 14 where a listener 27 is surrounded by an ensemble of loudspeakers 2 which target the reproduction of at least one virtual source 5 in a very restricted preferred area 6 around the head of the listener 27.

Applications of the invention are including but not limited to the following domains: hifi sound reproduction, home theatre, interior noise simulation for a car, interior noise simulation for an aircraft, sound reproduction for Virtual Reality, sound reproduction in the context of perceptual unimodal/crossmodal experiments. It should be clear for those skilled in the art that a plurality of virtual sources could be synthesized according to the invention corresponding to a plurality of first audio input signal.

NAMING OF ELEMENTS

1 first input audio signal
2 plurality of loudspeakers
2.1 loudspeakers located within the source/listener visibility area 30
2.2 loudspeakers located outside of the source/listener visibility area 30
3 second audio input signals
4 synthesized sound field
5 irtual source
6 preferred listening area
6.1 first preferred listening area
6.2 second preferred listening area
6.3 third preferred listening area
7 positioning filters coefficients
8 virtual source description data
9 loudspeakers description data
10 listening area description data
11 loudspeaker ranking data
12 third audio input signals
13 reference listening position
14 sound field filtering device
15 positioning filters computation device
16 listening area adaptation computation device
17 loudspeaker ranking computation device
18 source/listener line joining the virtual source 5 and the reference listening position 13
19 distance of loudspeaker 2 to source/listener line 18
20 boundaries of source/listener visibility area
21 loudspeaker located within the source/listener visibility area 30 considered for loudspeaker ranking 11 calculation
22 loudspeaker located outside of the source/listener visibility area 30 considered for loudspeaker ranking 11 calculation
23 distance of loudspeaker located outside of the source/listener visibility area to the boundaries of source/listener visibility area
24 sofa
25 source/loudspeaker visibility area
26 couch
27 listener
28 tracking device
29 actual preferred listening area
30 source/listener visibility area
31 source visibility area

32 modification filters coefficients computation device
33 modification filters coefficients
34 second audio input signals modification device
35 reference position

The invention claimed is:

1. A method for sound field reproduction from a first audio input signal using a plurality of loudspeakers aiming at synthesizing a sound field within a preferred listening area in which none of the loudspeakers are located, said sound field being described as emanating from a virtual source, said method comprising steps of calculating positioning filter coefficients using virtual source description data and loudspeaker description data according to a sound field reproduction technique which is derived from a surface integral, and applying positioning filter coefficients to filter the first audio input signal to form second audio input signals, said method further including the steps of:

defining a loudspeaker ranking by means of loudspeaker ranking data representing the importance of each loudspeaker for the synthesis of the sound field within the preferred listening area;

modifying the second audio input signals according to the loudspeaker ranking data to form third audio input signals; and alimenting loudspeakers with the third audio input signals for synthesizing a sound field.

2. The method of claim 1, wherein the loudspeaker ranking data are defined using the virtual source description data, loudspeaker description data and listening area description data.

3. The method of claim 1, wherein the loudspeaker ranking is typically lower for the loudspeakers located outside of a source/listener visibility area than for the loudspeakers located within the source/listener visibility area.

4. The method of claim 3, wherein the source/listener visibility area is defined by the minimum solid angle at the virtual source that encompasses the entire preferred listening area.

5. The method of claim 3, wherein the loudspeaker ranking data of the loudspeakers located outside of the source/listener visibility area are defined by a decreasing function of the distance of the loud-speakers to boundaries of the source/listener visibility area.

6. The method of claim 1, wherein the loudspeaker ranking data are defined by a decreasing function of the distance of the position of each loudspeaker to the line joining the position of the virtual source and a reference listening position in the preferred listening area.

7. The method of claim 1, wherein the modification of the second audio input signals to form third audio input signals implies at least to reduce the level of the second audio input signals of loudspeakers having low ranking.

8. The method of claim 1, wherein the modification of the second audio input signals to form third audio input signals implies at least to reduce the level of the second audio input signals of the loudspeakers having low ranking, and wherein the level reduction of the second audio input signals of the loudspeakers having a low ranking is frequency dependent.

9. The method of claim 1, wherein modifying the second audio input signals according to the loudspeaker ranking data to form third audio input signals is performed in order to increase, in the preferred listening area, the Nyquist frequency associated to the spatial sampling of the required loudspeaker distribution in the definition of the sound field rendering technique that is used to calculate the positioning filter coefficients.

10. A device for sound field reproduction from a first audio input signal using a plurality of loudspeakers aiming at synthesizing a sound field within a preferred listening area in which none of the loudspeakers are located, said sound field being described as emanating from a virtual source, comprising a sound field filtering device to compute second audio input signals from the first audio input signal using positioning filter coefficients, said positioning filter coefficients being calculated in a positioning filters computation device using virtual source description data and loudspeaker description data, further comprising a loudspeaker ranking computation device to compute loudspeaker ranking data representing the importance of each loudspeaker for the synthesis of the sound field within the preferred listening area, and by a listening area adaptation computation device designed to modify the second audio input signals according to the loudspeaker ranking data and to form third audio input signals that aliment the loudspeakers.

11. The device of claim 10, wherein the listening area adaptation computation device comprises a modification filters coefficients computation device to compute modification filters coefficients.

12. The device of claim 10, wherein the listening area adaptation computation device comprises a modification filters coefficients computation device for computing modification filters coefficients and further comprising a second audio input signals modification device that modifies the second audio input signals using the modification filters coefficients.

* * * * *